US006973961B2

(12) United States Patent
Rehberg et al.

(10) Patent No.: US 6,973,961 B2
(45) Date of Patent: Dec. 13, 2005

(54) PLATE-TYPE HEAT EXCHANGER WITH SINGLE-WALLED AND DOUBLE-WALLED HEAT TRANSFER PLATES

(75) Inventors: Peter Rehberg, Berlin (DE); Ralf Lauer, Markleeburg (DE)

(73) Assignee: WTT-Wilchwitzer Thermo-Technik GmbH, Nobitz-Wilchwitz (DE)

( * ) Notice: Subject to any disclaimer, the term of this patent is extended or adjusted under 35 U.S.C. 154(b) by 0 days.

(21) Appl. No.: 10/841,084

(22) Filed: May 7, 2004

(65) Prior Publication Data

US 2004/0256083 A1 Dec. 23, 2004

(30) Foreign Application Priority Data

May 8, 2003 (DE) ..... 103 20 812

(51) Int. Cl.[7] ..... F28F 3/08
(52) U.S. Cl. ..... 165/70; 165/167
(58) Field of Search ..... 165/70, 140, 166, 165/167

(56) References Cited

U.S. PATENT DOCUMENTS 4,249,597 A * 2/1981 Carey ..... 165/166
4,678,027 A * 7/1987 Shirey et al. ..... 165/70
5,178,207 A * 1/1993 Bergqvist et al. ..... 165/70
5,291,945 A * 3/1994 Blomgren et al. ..... 165/167
5,443,115 A * 8/1995 Pedersen et al. ..... 165/70
5,487,424 A * 1/1996 Davison ..... 165/166
5,913,361 A * 6/1999 Engstrom et al. ..... 165/70
6,662,862 B1 * 12/2003 Lindholm ..... 165/166

FOREIGN PATENT DOCUMENTS

DE 3903084 A1 * 8/1990 ..... F28D/9/00
JP 59074496 A * 4/1984 ..... F28F/3/08

* cited by examiner

*Primary Examiner*—Allen J. Flanigan
(74) *Attorney, Agent, or Firm*—Merchant & Gould

(57) ABSTRACT

The invention relates to a plate-type heat exchanger (20) comprising a stack (21) of heat exchanger plates which are permanently interconnected and between which separate flow passage spaces are defined for at least two heat exchange fluids. One part of the heat exchanger plates is designed as single-walled heat exchanger plates each, having one plate member, while another part of the heat exchanger plates is designed as double-walled heat exchanger plates each, having two plate members.

2 Claims, 5 Drawing Sheets

PLATE-TYPE HEAT EXCHANGER WITH SINGLE-WALLED AND DOUBLE-WALLED HEAT TRANSFER PLATES

The invention relates to the technical field of plate-type heat exchangers.

Plate-type heat exchangers are used to transfer thermal energy between heat exchange fluids. At least two heat exchange fluid streams flow through separate flow passage spaces defined between heat exchanger plates in the plate-type heat exchanger. Usually, the heat exchanger plates are arranged in a stack forming part of the plate-type heat exchanger. The separate flow passage spaces are established by means of breakthroughs in the heat exchanger plates and intermediate spaces between the heat exchanger plates. Heat transfer between the at least two heat exchange fluids essentially takes place in the area of a central heat transfer portion of the heat exchanger plates. To transfer thermal energy, one of the heat exchange fluids flows through a flow passage space at one side of a heat exchanger plate, while another heat exchange fluid flows through a flow passage space at the other side of the heat exchanger plate. Heat thus is exchanged between the two heat exchange fluids flowing in countercurrents through the heat exchanger plate.

Apart from plate-type heat exchangers in which the stacked heat exchanger plates each are designed as a single-walled heat exchanger plate having a single plate member, other plate-type heat exchangers are known in which all the heat exchanger plates of the stack relevant for transferring heat are designed as double-walled heat exchanger plates. Double-walled heat exchanger plates are composed of two plate members which are in close engagement with each other at least in the area of the central heat transfer portion. Compared with single-walled heat exchanger plates, double-walled heat exchanger plates can meet a higher safety standard since the two heat exchange fluids will not mix if a leak should occur in one of the two plate members of the double-walled heat exchanger plate. This is so because any liquid seeping out will merely get into the space between the two plate members, more specifically outwardly into the edge portion, rather than to the other side of the heat exchanger plate. Plate-type heat exchangers comprising a stack of double-walled heat exchanger plates in particular may be used for applications where three separate flow passage spaces for three heat exchange fluids are provided by breakthroughs in the heat exchanger plates and by the intermediate spaces between heat exchanger plates in a plate-type heat exchanger.

It is the object of the invention to indicate an improved plate-type heat exchanger which offers a wider range of applications for use of plate-type heat exchangers.

The object is met, in accordance with the invention, by a plate-type heat exchanger according to independent claim 1.

The invention involves the concept of providing a plate-type heat exchanger comprising a stack of heat exchanger plates which are permanently interconnected and between which separate flow passage spaces for at least two heat exchange fluids are formed, one part of the heat exchanger plates which are useful for heat transfer being designed as single-walled heat exchanger plates each, having one plate member, and another part of the heat exchanger plates which are useful for heat transfer being designed as double-walled heat exchanger plates each, having two plate members. Plate-type heat exchangers thus can be produced which, being a single structural element, have sections in the stack of heat exchanger plates that fulfill different safety standards. The combination of single-and double-walled heat exchanger plates in one and the same plate-type heat exchanger permits plate-type heat exchangers to be produced for applications which, to a certain extent, require provision of the more expensive double-walled heat exchanger plates in order to guarantee that a higher safety standard is met. Besides that, however, at least part of the heat exchanger plates may be of the single-walled design in cases where a lower safety standard is sufficient regarding some of the flow passage spaces defined in the plate-type heat exchanger. That is the case especially if the plate-type heat exchanger is formed with flow passage spaces for more than two heat exchange fluids. In that event, often the heat transfer between one of the heat exchange fluids and another one of the heat exchange fluids must meet a higher safety standard, thus requiring the double-walled embodiment of the heat exchanger plates. And as regards heat transfer between the one heat exchange fluid and another one of the heat exchange fluids, a lower safety standard may be adequate so that the heat exchanger plates here may be of the single-walled structure.

The combination of single-and double-walled heat exchanger plates, moreover, has the advantage that the more efficient heat transfer in a plate-type heat exchanger, normally made up of double-walled heat exchanger plates, can be exploited in connection with the single-walled heat exchanger plates. Furthermore, the combination of the two types of heat exchanger plates contributes to lowering the manufacturing costs as compared to known plate-type heat exchangers equipped exclusively with double-walled heat exchanger plates.

The advantages of the combined utilization of single-and double-walled heat exchanger plates in one plate-type heat exchanger can be utilized most profitably if separate flow passage spaces are formed between the heat exchanger plates for three heat exchange fluids.

The invention will be described further, by way of example, with reference to the accompanying drawing, in which.

Figure 1:
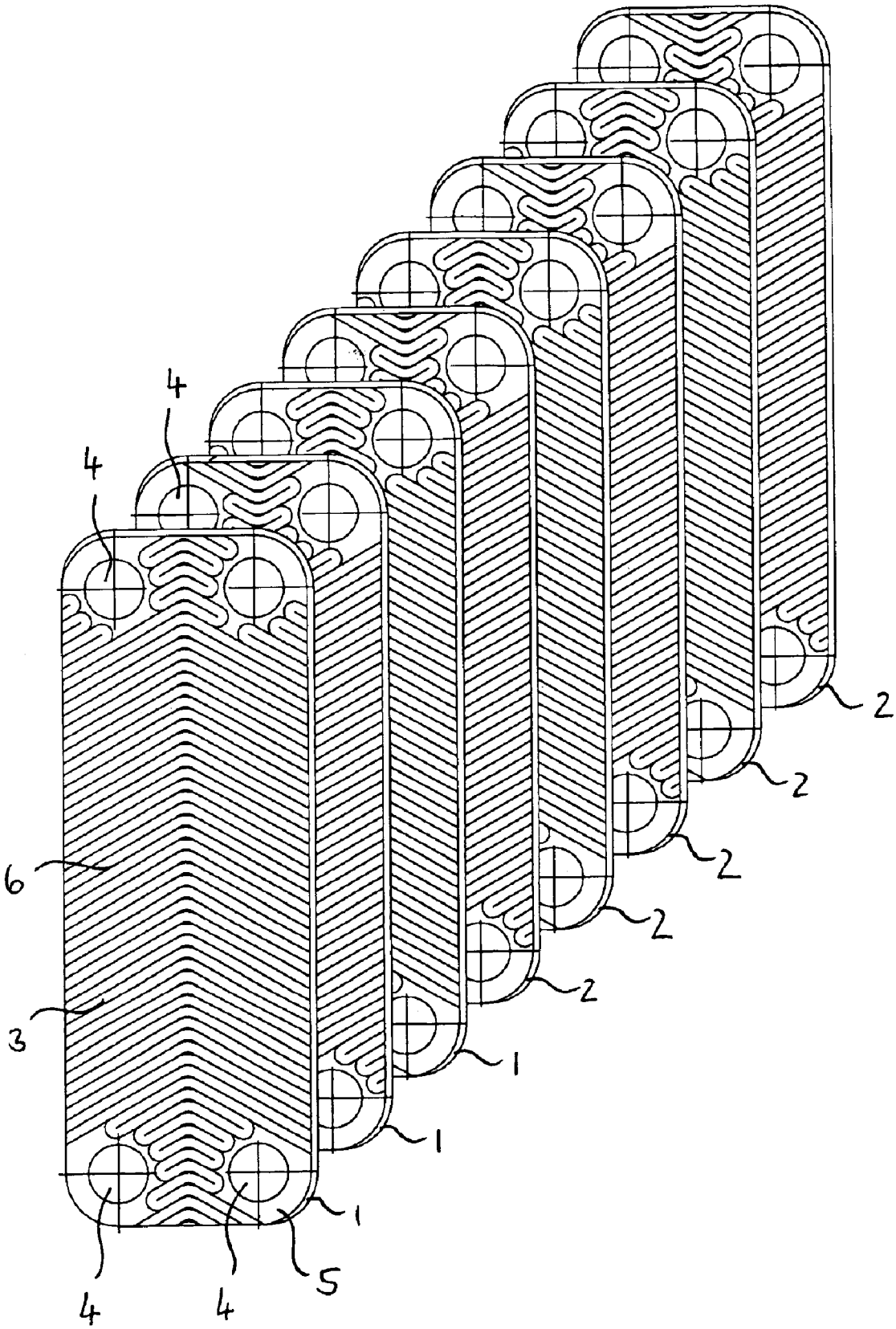
FIG. 1 shows a stack comprising a plurality of heat exchanger plates.

FIG. 1 is a diagrammatic illustration of an arrangement comprising a plurality of single-walled heat exchanger plates 1 and a plurality of double-walled heat exchanger plates 2. The two types of heat exchanger plates each dispose of a central heat transfer portion 3 and breakthroughs 4 in corner zones 5. The area outside of the breakthroughs 4 is formed with embossings 6 to create surface structures. The embossings 6 enhance the mutually spaced arrangement of the single-/double-walled heat exchanger plates 1, 2 to define the flow passage spaces when the single-/double-walled heat exchanger plates 1, 2 are used in a plate-type heat exchanger.

Figure 2:
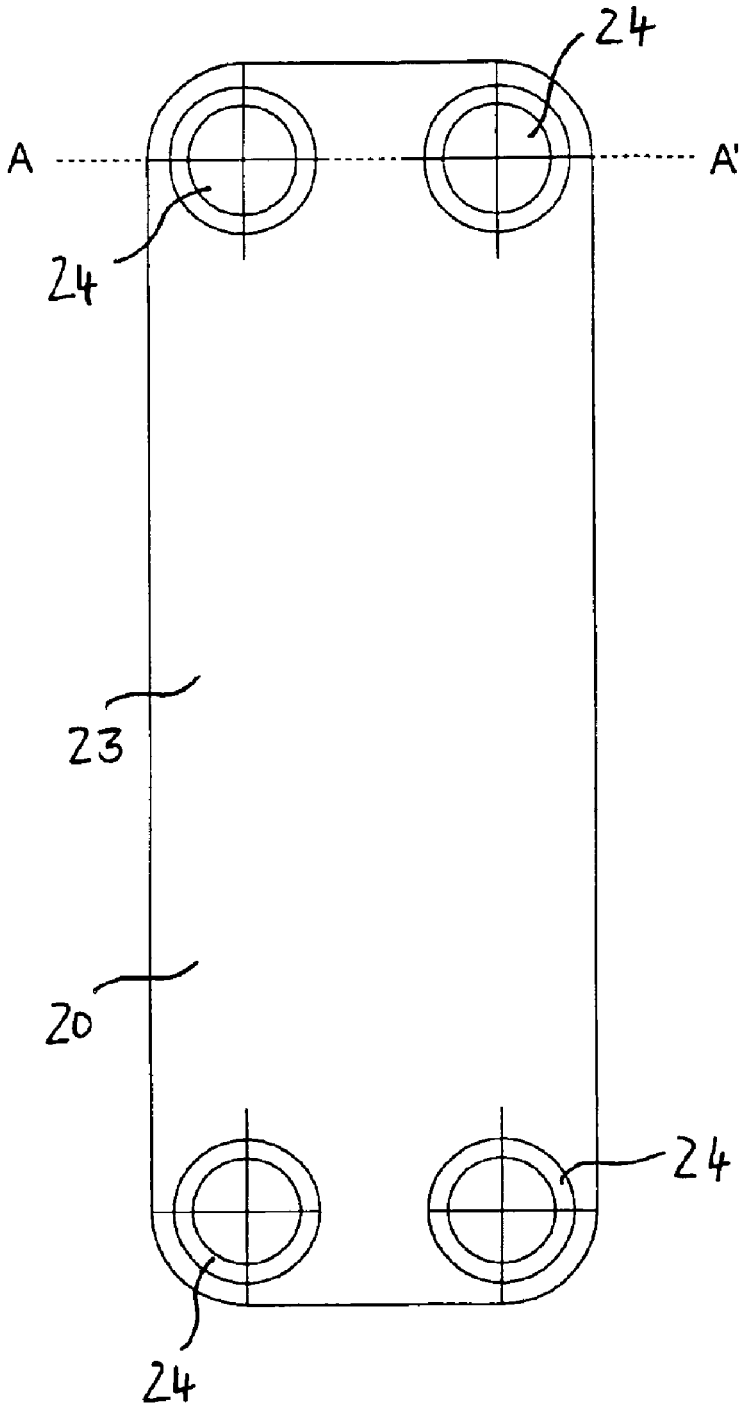
FIG. 2 is a diagrammatic front elevation of a plate-type heat exchanger.
Figure 3:
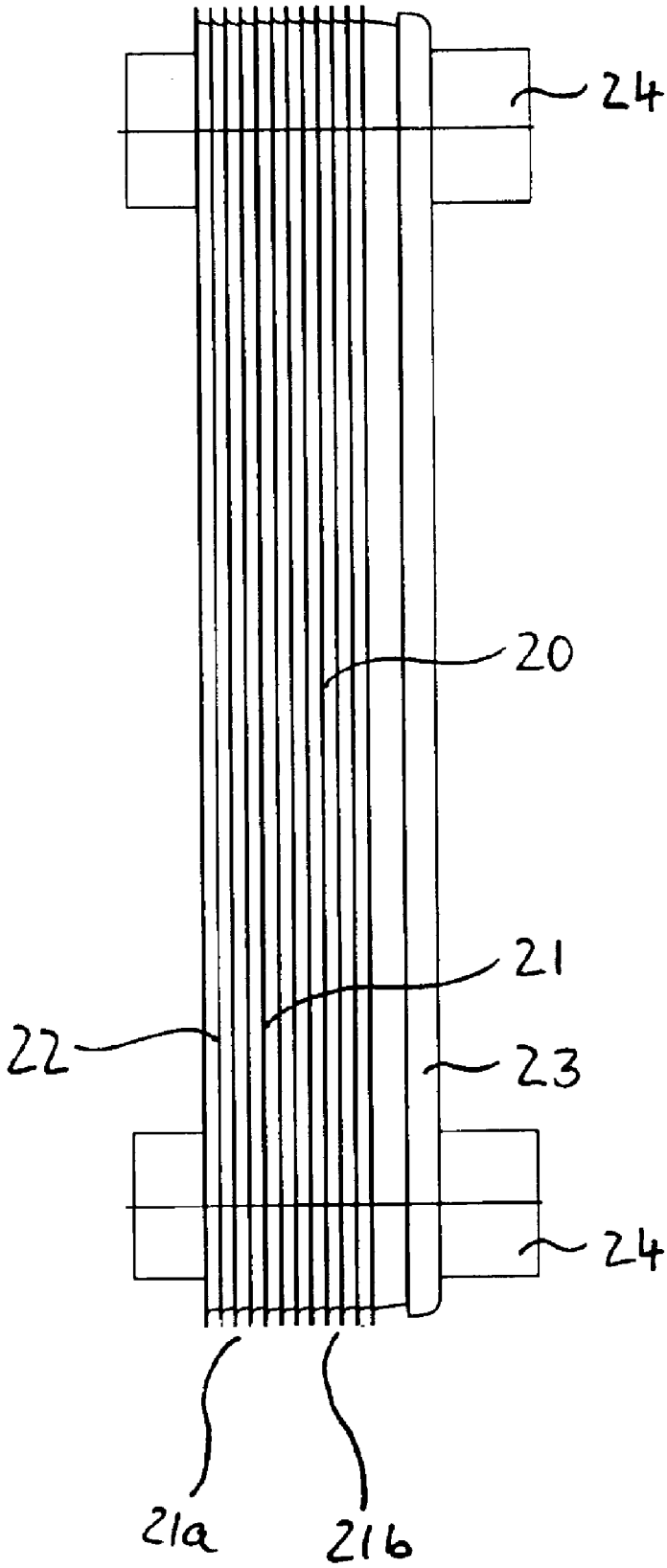
FIG. 3 is a diagrammatic side elevation of the plate-type heat exchanger shown in FIG. 2.

FIGS. 2 and 3 show a plate-type heat exchanger in front and side elevations, respectively. The plate-type heat exchanger comprises a stack 21 with the arrangement of single-/double-walled heat exchanger plates 1, 2 as shown in FIG. 1, the single-/double-walled heat exchanger plates 1, 2 being connected permanently by soldering. Furthermore, the plate-type heat exchanger 20 comprises two outer plates 22, 23 provided with connections 24 for supply and discharge of the heat exchange fluids. Separate flow passage spaces for the heat exchange fluids introduced/discharged through the connections 24 are formed between the plurality of heat exchanger plates 1, 2. The heat exchange fluids are passed in countercurrents through the separate flow passage spaces along the heat exchanger plates 1, 2. In the central heat transfer portions 3 of the single-/double-walled heat exchanger plates 1, 2 the embossings 6 provoke a highly turbulent stream of heat exchange fluids between the plurality of heat exchanger plates 1, 2.

Figure 4:
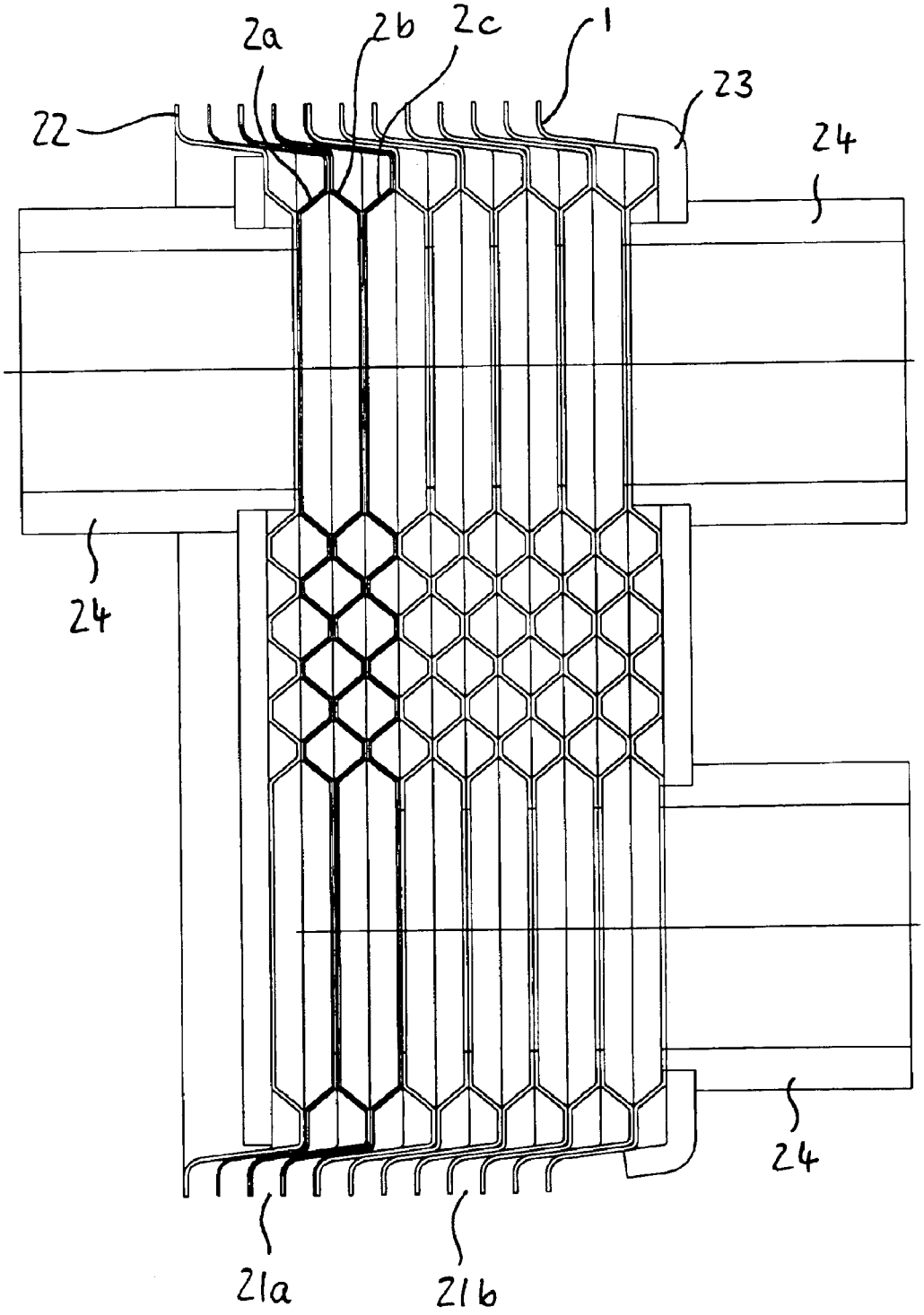
FIG. 4 is a cross sectional view of the plate-type heat exchanger shown in FIG. 2 along line A–A' of FIG. 2.
Figure 5:
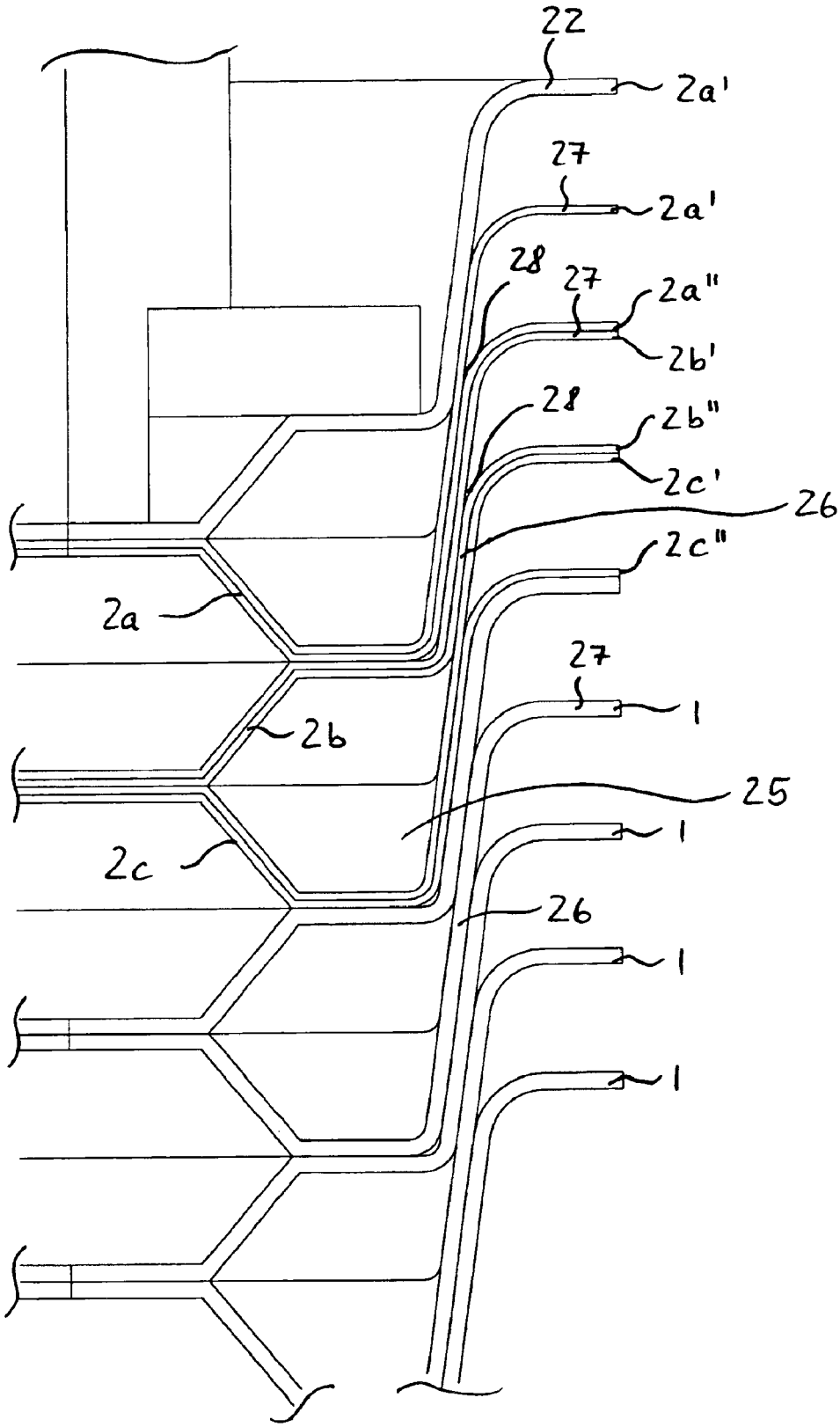
FIG. 5 is an enlarged view of an edge portion of the cross sectional illustration in FIG. 4.

FIG. 4 is a cross sectional elevation of the plate-type heat exchanger 20 shown in FIG. 2, as seen along line A–A' in FIG. 2. The stack 21 including the single-walled and the double-walled heat exchanger plates 1, 2 is arranged between the outer plates 22, 23. FIG. 5 is an enlarged view of an edge portion 25 of the cross sectional presentation in FIG. 4. Thus it may be seen that, in the embodiment illustrated of the plate-type heat exchanger 20, the stack 21 comprises three double-walled heat exchanger plates 2*a*, 2*b*, 2*c*, each including two plate members 2*a*', 2*a*", 2*b*', 2*b*", and 2*c*', 2*c*", respectively. Both the single-walled and the double-walled heat exchanger plates 1, 2 comprise an edge 26 which is bent upwardly with respect to the plane of the central heat transfer portion 3. In the embodiment shown, an optional outer edge 27 is formed integrally with the edge 26, this outer edge 27 being bent outwardly so that it extends substantially parallel to the plane of the central heat transfer portion 3. The outer edge 27 may be omitted in an alternative embodiment.

As may be seen in FIG. 5, the outer edges 27 of the two plate members 2*a*', 2*a*", 2*b*', 2*b*" and 2*c*', 2*c*", respectively, of the double-walled heat exchanger plates 2*a*, 2*b*, 2*c* are spaced from each other, while the outer edges 27 of the neighboring double-walled heat exchanger plates 2*a* and 2*b* as well as 2*b* and 2*c* closely engage each other. Therefore, any heat exchange fluid getting between the plate members 2*a*', 2*a*", 2*b*', 2*b*", or 2*c*', 2*c*", respectively, because of a leak in one of the two plate members 2*a*', 2*a*", 2*b*', 2*b*", or 2*c*', 2*c*" and reaching the zone of the edge 26 by capillary action becomes visible from outside already in an area 28.

In the embodiment described of the plate-type heat exchanger 20 the single-walled and the double-walled heat exchanger plates 1, 2 each are united in separate stacks 21*a*, 21*b*. Yet any desired combination of single-walled and double-walled heat exchanger plates 1, 2 may be provided, such as a plurality of stacks of single-walled/double-walled heat exchanger plates 1, 2 in one plate-type heat exchanger.

The features of the invention disclosed in the specification above, in the claims and drawing may be significant for implementing the invention in its various embodiments, both individually and in any combination.

What is claimed is:

1. A plate-type heat exchanger comprising a stack of heat exchanger plates which are permanently interconnected and between which separate flow passage spaces are defined for at least two heat exchange fluids, characterized in that one part of the heat exchanger plates is designed as single-walled heat exchanger plates each having one plate member, another part of the heat exchanger plates is designed as double-walled heat exchanger plates each having two plate members, and the stack of single-walled heat exchanger plates and double-walled heat exchanger plates is arranged between outer plates.

2. A plate-type heat exchanger comprising a stack of heat exchanger plates which are permanently interconnected and between which separate flow passage spaces are defined for at least two heat exchange fluids, characterized in that one part of the heat exchanger plates is designed as single-walled heat exchanger plates each having one plate member, and another part of the heat exchanger plates is designed as double-walled heat exchanger plates each having two plate members, and in that separate flow passage spaces are defined between the heat exchanger plates for three heat exchange fluids.

* * * * *